US008599180B2

(12) United States Patent
Yu et al.

(10) Patent No.: US 8,599,180 B2
(45) Date of Patent: Dec. 3, 2013

(54) DRIVING CIRCUIT AND LIQUID CRYSTAL DISPLAY USING THE SAME

(75) Inventors: Qi-Long Yu, Shenzhen (CN); Jun Zhang, Shenzhen (CN); Jun-Wei Zhang, Shenzhen (CN); Chia-Hung Chien, New Taipei (TW); Tsung-Jen Chuang, New Taipei (TW); Shih-Fang Wong, New Taipei (TW)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 286 days.

(21) Appl. No.: 13/234,097

(22) Filed: Sep. 15, 2011

(65) Prior Publication Data

US 2013/0009926 A1 Jan. 10, 2013

(30) Foreign Application Priority Data

Jul. 8, 2011 (CN) ..... 2011 1 0190704

(51) Int. Cl.
*G09G 5/00* (2006.01)

(52) U.S. Cl.
USPC ..... 345/205; 345/98; 345/211

(58) Field of Classification Search
None
See application file for complete search history.

(56) References Cited

U.S. PATENT DOCUMENTS

| | | | | |
|---|---|---|---|---|
| 7,151,518 | B2 * | 12/2006 | Fukumoto et al. | 345/96 |
| 7,173,597 | B2 * | 2/2007 | Kato | 345/99 |
| 8,009,134 | B2 * | 8/2011 | Mamba et al. | 345/98 |
| 8,044,917 | B2 * | 10/2011 | Oh et al. | 345/100 |
| 8,059,074 | B2 * | 11/2011 | Kim et al. | 345/87 |
| 2007/0024560 | A1 * | 2/2007 | Kim et al. | 345/94 |
| 2008/0094386 | A1 * | 4/2008 | Park et al. | 345/212 |

* cited by examiner

*Primary Examiner* — Jason Olson
(74) *Attorney, Agent, or Firm* — Altis & Wispro Law Group, Inc.

(57) ABSTRACT

A driving circuit for driving an LCD includes a common electrode, a number of pixel electrodes, a peripheral circuit, and a processing unit including a first input/output (I/O) port, a second I/O port; and a number of third I/O ports. The first I/O port and the second I/O ports are connected to the common electrode via the peripheral circuit, and each third I/O port is connected to a different pixel electrode. The processing unit controls the first I/O port, the second I/O port, and the third I/O ports to output a first or second voltage according to a display signal, thus the pixel electrodes are at the first or the second voltage accordingly, the common electrode is at a voltage in a range between the second voltage and the first voltage in receiving the voltage output by the peripheral circuit, thus driving the LCD to display an image.

11 Claims, 3 Drawing Sheets

DRIVING CIRCUIT AND LIQUID CRYSTAL DISPLAY USING THE SAME

BACKGROUND

1. Technical Field

The present disclosure relates to driving circuits, particularly, to a liquid crystal display driving circuit.

2. Description of Related Art

Liquid Crystal Displays (LCDs) include a display panel with a number of crystal molecules, and an LCD driving circuit for a number of pixel electrodes, and a common electrode to driving the display panel. However, many LCD driving circuits are complex and expensive, thus increasing the manufacturing cost.

Therefore, it is desirable to provide an LCD driving circuit to overcome the described limitations.

BRIEF DESCRIPTION OF THE DRAWINGS

Many aspects of the present disclosure are better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail, with reference to the accompanying drawings.

Figure 1:
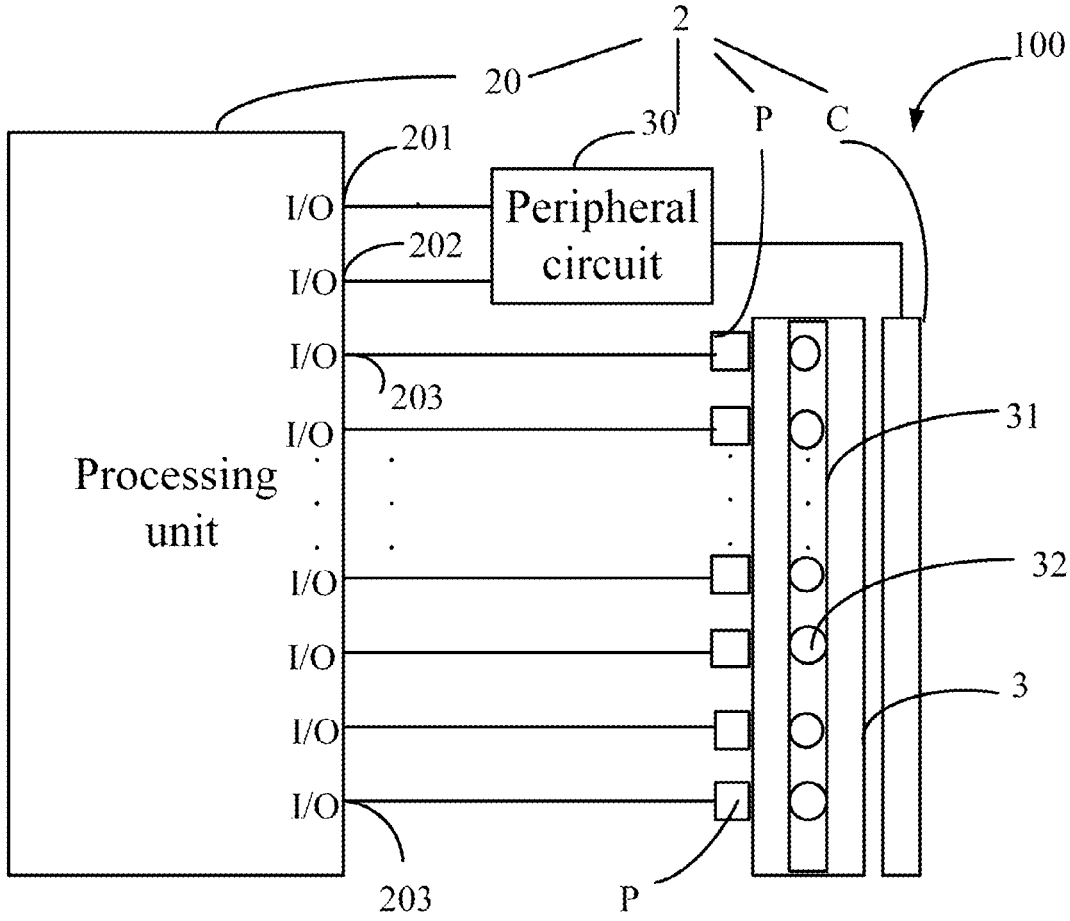
FIG. 1 is a schematic diagram of a liquid crystal display, in accordance with an exemplary embodiment.

Referring to FIG. 1, an LCD 100 includes a driving circuit 2 and a display panel 3. The driving circuit 2 includes a processing unit 20, a peripheral circuit 30, a common electrode C, and a number of pixel electrodes P. The pixel electrodes P are arranged in a matrix pattern, and each pixel electrode P corresponds to one pixel point. The processing unit 20 includes a first input/output (I/O) port 201, a second I/O port 202, and a number of third I/O ports 203. The first I/O port 201 and the second I/O port 202 are electrically connected to the common electrode C via the peripheral circuit 30, and each of the third I/O ports 203 is respectively connected to one of the pixel electrodes P. The display panel 3 is located between the common electrode C and the pixel electrodes P, and includes a liquid crystal film 31. The liquid crystal film 31 includes a number of liquid crystal molecules 32, each of which corresponds to one of the pixel electrodes P.

The processing unit 20 controls the first I/O port 201, the second I/O port 202, and the third I/O ports 203 to output either a first voltage or a second voltage according to a display signal. In the embodiment, the first voltage is a high voltage, such as 5 volts, the second voltage is a zero voltage. Thus the pixel electrodes P connected to the third I/O port 203 are at either the first voltage or the second voltage. The peripheral circuit 30 processes the first voltage or the second voltage outputted by the first I/O port 201 and the second I/O port 202, and itself outputs a voltage, which is in the range between the first voltage and the second voltage, to the common electrode C. Thus, the liquid crystal molecules 32 are driven to rotate and the display panel 3 displays an image corresponding to the display signal.

Since the voltage output to the common electrode C and the pixel electrodes P can have different values, the voltage difference between one of the pixel electrodes P and the common electrode C is accordingly similar. For example, if one pixel electrode P is at the first voltage and the common electrode C is at the second voltage, the voltage difference between the pixel electrode P and the common electrode C is equal to the first voltage; if the one pixel electrode P is at the first voltage and the common electrode C is also at the first voltage, then the voltage difference between the pixel electrode P and the common electrode C is zero.

When a voltage difference exists between one of the pixel electrodes P and the common electrode C, the liquid crystal molecule 32 which corresponds to the pixel electrode P is rotated in a degree corresponding to the voltage difference, and the pixel point corresponding to the pixel electrode P will display a corresponding gray level. As is known, the term "gray level" is one of shades of gray, varying from black at the weakest intensity to white at the strongest. Therefore, by controlling the voltage output by the first I/O port 201, the second I/O port 202, and the number of the third I/O ports 203 via the processing unit 20, the display panel 3 displays the image corresponding to the display signal. In the embodiment, the display signal can be any visual signal received from a computer, a media player, and the like.

Figure 2:
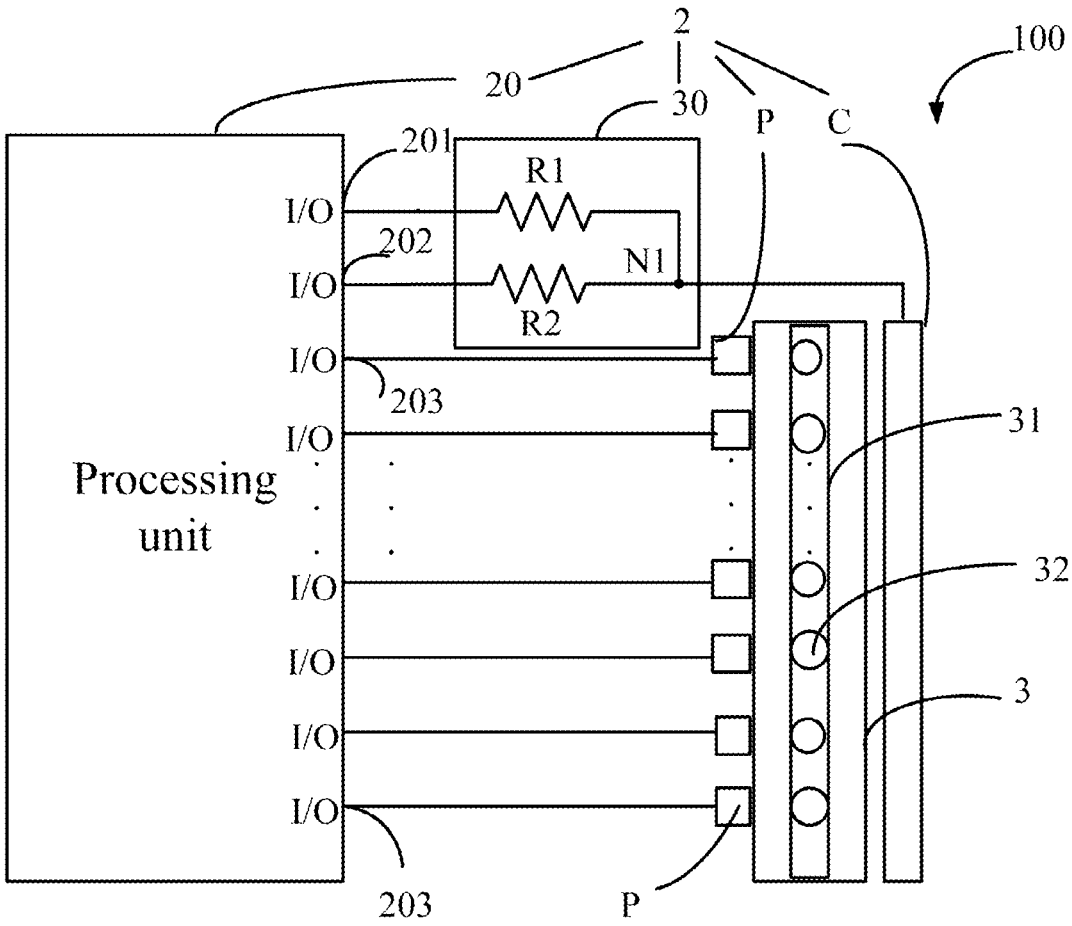
FIG. 2 is a circuit diagram of the liquid crystal display of FIG. 1, in accordance with a first embodiment.

Referring to FIG. 2, in the embodiment, the peripheral circuit 30 includes resistors R1 and R2 which are connected between the first I/O port 201 and the second I/O port 202 in series. A connection point N1 of the resistors R1 and R2 is connected to the common electrode C. In the embodiment, the resistance value of the resistor R1 is the same as that of the resistor R2.

Suppose that the value of the first voltage is Vcc, then the resistance value of both the resistors R1 and R2 is R. As shown in FIG. 2, when the first I/O port 201 and the second I/O port 202 are both outputting the first voltage, the common electrode C is at the first voltage. When the first I/O port 201 and the second I/O port 202 are both outputting the second voltage, the common electrode C is at the second voltage. When one of either the first I/O port 201 or the second I/O port 202 is outputting the first voltage, the other is outputting the second voltage, it is obvious that the voltage of the common electrode C is $Vcc*R/(R+R)=Vcc/2$. Therefore, in the embodiment, the voltage output by the peripheral circuit 30 can be the first voltage, the second voltage, or one half of the first voltage. Thus the voltage of the common electrode C can be Vcc, Vcc/2, or zero, and the voltage of the pixel electrode P can be Vcc, or zero. Accordingly, as described above, the voltage difference between one of the pixel electrodes P and the common electrode C can be Vcc, Vcc/2, 0, −Vcc/2, or −Vcc. If the voltage between one of the pixel electrodes P and the common electrode C is different, the gray level displayed by the pixel point corresponding to the pixel electrode P will be different, therefore, in the embodiment, each pixel point can display five gray levels.

Figure 3:
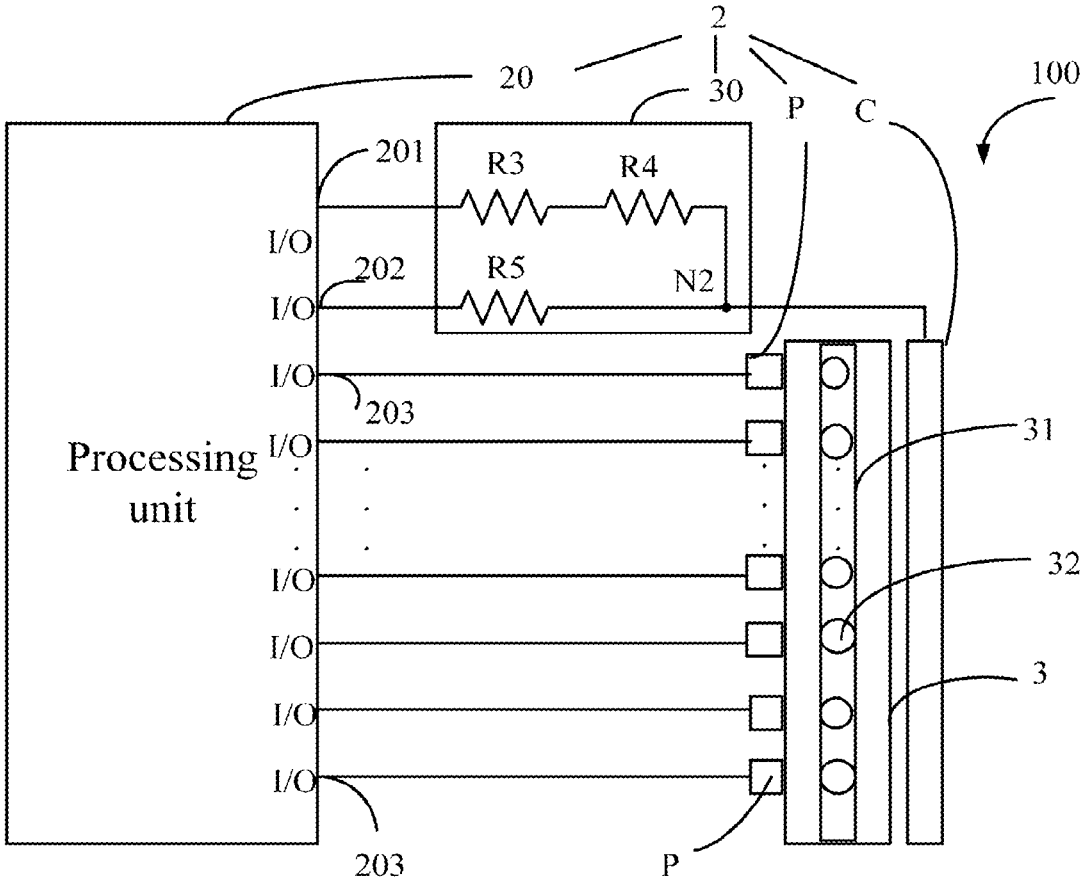
FIG. 3 is a circuit diagram of the liquid crystal display of FIG. 1, in accordance with a second embodiment.

Referring to FIG. 3, in the embodiment, the peripheral circuit 30 includes three resistors R3, R4, and R5 which are connected between the first I/O port 201 and the second I/O port 202 in series. The three resistors R3, R4, and R5 thus form two connection points, and the common electrode C is connected to one of the two connection points. For example, as shown in FIG. 3, the common electrode C is connected to a connection point N2 of the resistors R4 and R5. In the embodiment, the resistance values of the three resistors R3, R4, and R5 are all the same.

In the embodiment, also suppose that the value of the first voltage is Vcc, and the resistance value of each of the resistors R3, R4 and R5 is R. As shown in FIG. 3, when the first I/O port 201 and the second I/O port 202 are both outputting the first voltage, then the common electrode C is at the first voltage. When the first I/O port 201 and the second I/O port 202 are both outputting the second voltage, then the common electrode C is at the second voltage.

When one of either the first I/O port 201 or the second I/O port 202 is outputting the first voltage and the other is outputting the second voltage, the voltage of the common electrode C will be either Vcc*R/(R+R+R)=Vcc/3 or Vcc*(R+R)/(R+R+R)=2*Vcc/3. In detail, when the first I/O port 201 is outputting the first voltage and the second I/O port 202 is outputting the second voltage, the voltage of the common electrode C will be Vcc*R/(R+R+R)=Vcc/3. When the first I/O port 201 is outputting the second voltage and the second I/O port 202 is outputting the first voltage, the voltage of the common electrode C will be Vcc*(R+R)/(R+R+R)=2*Vcc/3. Then the voltage of the common electrode C can be Vcc, 2*Vcc/3, Vcc/3, or zero, and the voltage of the pixel electrode P can be Vcc, or zero. As described above, the voltage between one of the pixel electrode P and the common electrode C can be Vcc, 2*Vcc/3, Vcc/3, 0, −Vcc/3, −2*Vcc/3, and −Vcc, and where the voltages between the one of the pixel electrodes P and the common electrode C are different, the gray level displayed by the pixel point corresponding to the pixel electrode P will be different, therefore, each pixel point can display seven gray levels. Obviously, in the embodiment, the voltage output by the peripheral circuit 30 can be the first voltage, or the second voltage, or a third of the first voltage, or two thirds of the first voltage.

Therefore, in the present embodiment, the driving circuit 2 can drive the display panel 3 to display an image in multiple degrees of gray by using a simple structure and at lower cost.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. A liquid crystal display comprising:

a driving circuit comprising:

a common electrode;

a plurality of pixel electrodes;

a peripheral circuit, and a processing unit comprising a first input/output (I/O) port, a second I/O port; and a plurality of third I/O ports, the first I/O port and the second I/O port being connected to the common electrode via the peripheral circuit, each third I/O port being respectively connected to one of the pixel electrodes; and a display panel located between the common electrode and the pixel electrodes, the display panel comprising a liquid crystal film, the liquid crystal film comprising a plurality of liquid crystal molecules, each liquid crystal molecule being corresponding to one pixel electrode;

wherein, the processing unit controls the first I/O port, the second I/O port, and the third I/O ports to output either a first voltage or a second voltage according to a display signal, thus the pixel electrodes connected to the third I/O ports are at the first voltage or the second voltage accordingly, the peripheral circuit processes the first voltage or the second voltage outputted by the first I/O port and the second I/O port and outputs a voltage which is in the range between the first voltage and the second voltage to the common electrode, thereby causing the liquid crystal molecules to rotate and the display panel to display an image corresponding to the display signal.

2. The liquid crystal display according to claim 1, wherein when a voltage difference exists between one of the pixel electrodes and the common electrode, the liquid crystal molecule which corresponds to the pixel electrode is rotated in a degree corresponding to the voltage difference, and the pixel point corresponding to the pixel electrode will display a corresponding gray level.

3. The liquid crystal display according to claim 1, wherein the peripheral circuit comprises a first resistor and a second resistor which are connected between the first I/O port and the second I/O port in series, a connection point of the first resistor and the second resistor is connected to the common electrode, and the resistance value of the first resistor is the same as that of the second resistor.

4. The liquid crystal display according to claim 3, wherein the first voltage is a high voltage and the second voltage is a zero voltage, when the first I/O port and the second I/O port both output the first voltage, the common electrode is at the first voltage; when the first I/O port and the second I/O port both output the second voltage, the common electrode is at the second voltage; when one of the first I/O port and the second I/O port outputs the first voltage and the other outputs the second voltage, the voltage of the common electrode is a half of the first voltage.

5. The liquid crystal display according to claim 1, wherein the peripheral circuit comprises a third resistor, a fourth resistor, and a fifth resistor which are connected between the first I/O port and the second I/O port in series, the common electrode is connected to one connection point of two resistors of the three resistors, and the resistance value of the three resistors are all the same.

6. The liquid crystal display according to claim 5, wherein the first voltage is a high voltage and the second voltage is a zero voltage, when the first I/O port and the second I/O port both output the first voltage, the common electrode is at the first voltage, when the first I/O port and the second I/O port both output the second voltage, the common electrode is at the second voltage; when one of the first I/O port and the second I/O port outputs the first voltage and the other outputs the second voltage, the voltage of the common electrode is either one third of the first voltage or two third of the first voltage.

7. A driving circuit, comprising:

a common electrode;

a plurality of pixel electrodes;

a peripheral circuit, and a processing unit comprising a first input/output (I/O) port, a second I/O port; and a plurality of third I/O ports, the first I/O port and the second I/O port being connected to the common electrode via the peripheral circuit, each third I/O port being respectively connected to one pixel electrode;

wherein, the processing unit controls the first I/O port, the second I/O port, and the third I/O ports to output either a first voltage or a second voltage according to a display signal, thus the pixel electrodes connected to the third I/O ports are at the first voltage or the second voltage accordingly, the peripheral circuit processes the first voltage or the second voltage outputted by the first I/O port and the second I/O port and outputs a voltage, which is in a range between the first voltage, to the second voltage to the common electrode.

8. The driving circuit according to claim 7, wherein the peripheral circuit comprises a first resistor and a second resistor which are connected between the first I/O port and the second I/O port in series, a connection point of the first resistor and the second resistor is connected to the common electrode, and the resistance value of the first resistor is the same as that of the second resistor.

9. The driving circuit according to claim 8, wherein the first voltage is a high voltage and the second voltage is a zero voltage, when the first I/O port and the second I/O port both output the first voltage, the common electrode is at the first voltage; when the first I/O port and the second I/O port both output the second voltage, the common electrode is at the second voltage; when one of the first I/O port and the second I/O port outputs the first voltage and the other outputs the second voltage, the voltage of the common electrode is a half of the first voltage.

10. The driving circuit according to claim 7, wherein the peripheral circuit comprises a third resistor, a fourth resistor, and a fifth resistor which are connected between the first I/O port and the second I/O port in series, the common electrode is connected to one connection point of two resistors of the three resistors, and the resistance value of the three resistors are all the same.

11. The driving circuit according to claim 10, wherein the first voltage is a high voltage and the second voltage is a zero voltage, when the first I/O port and the second I/O port both output the first voltage, the common electrode is at the first voltage, when the first I/O port and the second I/O port both output the second voltage, the common electrode is at the second voltage; when one of the first I/O port and the second I/O port outputs the first voltage and the other outputs the second voltage, the voltage of the common electrode is either one third of the first voltage or two third of the first voltage.

* * * * *